United States Patent [19]

Gromoll et al.

[11] Patent Number: 4,729,728

[45] Date of Patent: Mar. 8, 1988

[54] COMPRESSOR WITH IMPROVED LUBRICATING SYSTEM

[75] Inventors: Bernd Gromoll, Baiersdorf; Peter Gulden, Erlangen, both of Fed. Rep. of Germany

[73] Assignee: Siemens Aktiengesellschaft, Berlin and Munich, Fed. Rep. of Germany

[21] Appl. No.: 856,616

[22] Filed: Apr. 25, 1986

[30] Foreign Application Priority Data

May 8, 1985 [DE] Fed. Rep. of Germany ..... 3516593

[51] Int. Cl.[4] ..... F04C 29/02; F01M 1/08; F01M 11/02

[52] U.S. Cl. ..... 418/88; 418/94; 184/6.2

[58] Field of Search ..... 418/88, 94; 184/6.2, 184/6.16, 26, 55.2

[56] References Cited

U.S. PATENT DOCUMENTS 3,627,078 12/1971 Burrous ..... 184/6.2
4,391,573 7/1983 Tanaka et al. ..... 418/63

FOREIGN PATENT DOCUMENTS 2026868 12/1971 Fed. Rep. of Germany .
1364063 5/1964 France .
2211990 7/1974 France .
496796 12/1938 United Kingdom .

*Primary Examiner*—John J. Vrablik
*Attorney, Agent, or Firm*—Mark H. Jay

[57] ABSTRACT

Hermetically encapsulated rotary piston compressor with horizontally disposed, at least partially hollow crankshaft. The lubricating oil is sucked up by a dynamic vacuum created in a compressed gas line, out of an oil sump, by means of an oil suction pipe, and is conveyed together with the compressed gas into the hollow part of the crankshaft, which has inside the cylinder housing radial bores for oil supply to the moving parts of the compressor. According to the invention, the oil suction pipe is mounted for rotation about the axis of the crankshaft. Thereby the oil supply is maintained in any position resulting from any rotation of the compressor about the horizontal axis of its crankshaft.

6 Claims, 5 Drawing Figures

COMPRESSOR WITH IMPROVED LUBRICATING SYSTEM

BACKGROUND OF THE INVENTION

The invention relates to a hermetically encapsulated oil-lubricated rotary piston compressor with a horizontally disposed, at least partly hollow crankshaft, where the lubricating oil is sucked up from the oil sump by a dynamic vacuum created in the compressed gas line and is conveyed together with the compressed gas into the hollow part of the crankshaft, which has radial bores inside the cylinder housing for supplying oil to the relatively moving surfaces of the compressor.

Hermetically encapsuled, oil-lubricated rotary piston compressors with horizontally disposed crankshafts are employed, because of their compact construction, in such appliances as household refrigerators and air conditioners where the space needed should be minimized. Because the crankshaft does not dip into the oil sump at the bottom of the housing, additional measures are necessary for supplying oil to the rotating parts of a compressor of this type. Such measures have included an oil pump driven for example by the crankshaft, and also arrangements where a vacuum created in the flowing compressed gas sucks the lubricating oil into the interior of the crankshaft.

A hermetically encapsulated, oil-lubricated rotary piston compressor with horizontally disposed hollow crankshaft is known from U.S. Pat. No. 4,391,573. Here, the lubricating oil is conveyed by the compressed gas ejected from the compressor into the hollow crankshaft. Inside the cylinder housing, the crankshaft has radial bores through which the lubricating oil reaches the relatively moving surfaces of the compressor for lubrication and sealing. The compressed gas (ejected by the eccentric rotary motion of the rotary piston out of the pressure chamber of the compressor via the outlet opening) is conducted, via a line system situated outside the cylinder housing and firmly connected with it, to the end of the hollow crankshaft away from the drive side. A part of this line system consists of a horizontal outlet pipe which is placed in the oil sump and is provided with an opening into which a vertical suction pipe leads. The upper end of this suction pipe protrudes into the outlet pipe and has a beveled opening and forms in this manner a constriction in the outlet pipe. This produces a dynamic vacuum and the lubricating oil is sucked into the outlet pipe and transported further into the hollow crankshaft. Because the suction pipe ends near the bottom of the compressor housing wall of the hermetically encapsulated rotary piston compressor, the oil supply can still be maintained even at slight inclinations of the compressor. During rotation of the compressor about the axis of the crankshaft or about an axis parallel thereto, however, the oil supply is interrupted if the opening of the suction pipe is no longer in the oil sump.

One object of the invention is to provide a hermetically encapsulated, oil-lubricated rotary piston compressor where the oil supply is not interrupted by any rotation of the compressor about the horizontal axis of its crankshaft or an axis parallel thereto.

SUMMARY OF THE INVENTION

In accordance with the invention, the oil suction conduit is pivotally secured to the apparatus. The distal end of the oil suction conduit is therefore rotatable and will rotate into the oil sump under the influence of gravity. By this measure it is ensured that the opening of the oil suction pipe dips into the oil sump in any position resulting through the rotation of the compressor about the axis of the crankshaft, and the lubrication of the rotary piston compressor is thus maintained.

In an advantageous embodiment, the cross-section constriction in the compressed gas line is a rotationally-symmetrical nozzle, which is exchangeably inserted into the compressed gas line. Preferably the nozzle is installed coaxially with the crankshaft and is located outside the oil sump. In another advantageous embodiment, the nozzle leads into a mixing chamber in such a way that a suction chamber is located between the nozzle and the mixing chamber wall, and is connected via bores with the oil suction pipe. Contiguous to the mixing chamber is a diffusor, in which a low-loss conversion of speed to pressure takes place. Thereby the dynamic vacuum caused by the nozzle is utilized especially advantageously for suction of oil, and the mixing of the lubricating oil with the pressure gas is facilitated.

In another advantageous embodiment, the oil suction pipe bearing is in the form of a spherical bearing and the oil suction pipe can execute, within a predetermined angle range, additionally a rotary motion about an axis perpendicular to the axis of the crankshaft. Compared with an embodiment having a cylindrical bearing, the angle range within which the crankshaft can be inclined on the surface of the oil sump with the oil supply to the compressor being maintained is thereby increased.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
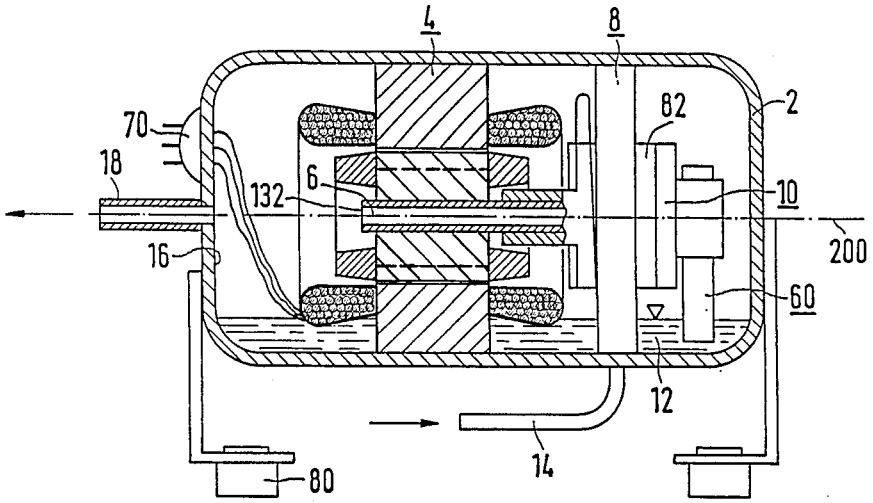
FIG. 1 shows schematically and in partial longitudinal section a hermetically encapsulated rotary piston compressor according to the invention.

In the embodiment of a hermetically encapsulated rotary piston compressor 8 according to FIG. 1, an electric motor 4 with a hollow, horizontally disposed motor shaft 6 is arranged in a compressor housing 2. The compressor 8 and housings are shown partly in section. The motor shaft 6 forms a crankshaft 6 of the rotary piston compressor 8, whose cylinder housing 82, firmly connected with the compressor housing 2, is provided with an oil suction device 10. The latter contains an oil suction pipe 60, which is mounted for rotation about the horizontal axis 200 of the hollow crankshaft 6 and which dips into an oil sump 12. At the compressor housing 2 are lead-throughs 70 for the electric connections of motor 4 and installation mounts 80.

The gas sucked up through an inlet pipe 14 is compressed in the rotary piston compressor 8 and is guided via a compressed gas line located in the cylinder housing 82 into the oil suction device 10. There the oil suction takes place, and the compressed gas-oil mixture passes into the hollow crankshaft 6. Through the radial bores in the hollow crankshaft 6 the oil gets to the relatively moving surfaces of the compressor for lubrication and sealing. The compressed gas together with the excess oil leaves at the motor-side end 132 of the hollow crankshaft 6. The excess oil is hurled against the compressor housing wall 16 and flows back from there to the oil sump 12. Via an outlet pipe 18 provided at the compressor housing 2 opposite the motor-side end 132 of the hollow crankshaft 6, the compressed gas is conducted on to a condenser (not shown).

Figure 2:
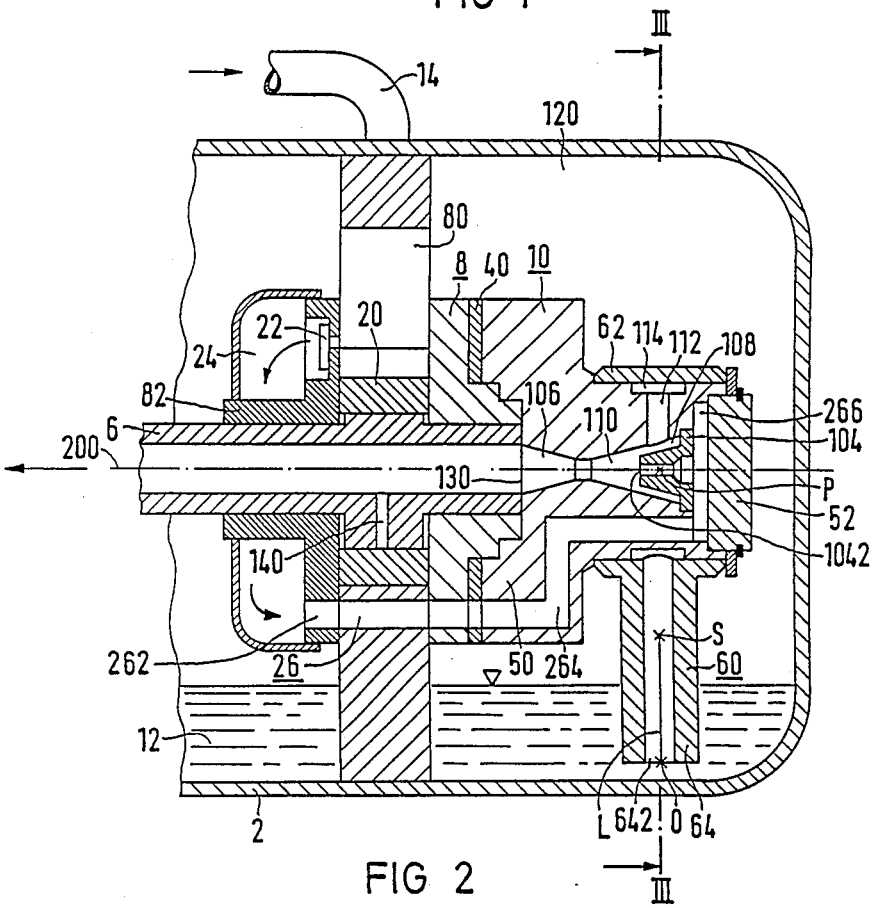
FIG. 2 illustrates an advantageous embodiment of the oil suction device.

The oil suction device 10 is shown in more detail in FIG. 2. The rotary piston compressor 8 contains a piston 20 revolving eccentrically in the cylinder housing 82. A separating valve 80 urged against the cylinder housing 82 by means of a spring (not shown) divides the space between cylinder housing 82 and piston 20 into a compression chamber and a suction chamber. The gas compressed by the revolving piston 20 in the compression chamber is ejected via a pressure valve 22 and is conducted via a first deflection chamber 24 and a compressed gas line 26 to the open end 130 of the hollow crankshaft 6 away from the drive. A part 262 of the compressed gas line is in the cylinder housing 82. A deflection element 50 is firmly connected with the cylinder housing 82 via a seal ring 40. In the deflection element 50 the compressed gas is conducted through a gas line 24 to a second deflection chamber 266 and is guided there into a constricted region through the nozzle 104. Nozzle 104 is rotatable and may, in an advantageous embodiment, form an exchangeable component inserted in the deflection element 50. Nozzle 104 leads into a likewise rotation-symmetrical mixing chamber 110, which is followed by a diffusor 106, in which the velocity energy is retransformed into pressure energy at low loss. The plane of the outlet opening 1042 of nozzle 104, the outer wall of nozzle 104, and a part of the inner wall of the mixing chamber 110 delimit a suction chamber 108. Into this suction chamber 108 lead bores 112 extending radially to axis 200. These bores 112 originate from a groove 114 of rectangular cross-section which is annularly surrounded by a hollow shaft bearing 62. The bearing 62 rotates about the axis 200 and rides on the outer wall of the deflection element 50, to provide a pivot for the oil suction pipe 60. At the outer jacket of bearing 62 a pipe 64 (which may be for example cylindrical) is applied, the axis of which is perpendicular to axis 200. The cylindrical pipe 64 is hollow inside and its bore leads into the annular groove 114. Bearing 62 and the hollow-cylindrical pipe 64 form the rotatably mounted oil suction pipe 60. The center of gravity S of the oil suction pipe 60 lies outside the axis 200 in pipe 64. The center O of the opening 642 and the center of gravity S of the oil suction pipe are located so that the extension of their connecting line L intersects the axis 200 at a point P. Because of this, and the rotatability of the oil suction pipe 60, the pipe 60 always aligns itself so that the cylindrical pipe 64 is at least approximately vertical. It is thereby ensured that, in any position of the rotary piston compressor resulting from any rotation about the horizontal axis 200 or an axis parallel thereto, an opening 642 at the end of the cylindrical pipe 64 is present in the oil sump 12. Pipe 64 is preferably long enough for the openign 642 to be close to the inner wall of the compressor housing 2. The oil suction pipe 60 is fitted onto the deflection element 50 and is secured against slipping off by a locking device 52. Due to the cross-sectional constriction of nozzle 104 in the compressed gas line 26 there thus results in the suction chamber 108 a vacuum in relation to the oil chamber 120. The lubricating oil is sucked via the cylindrical pipe 64 to the pressure take-off bores 112. Thence, the oil passes into the suction chamber 108 and is mixed in the mixing chamber 110 with the compressed gas. The compressed oil-gas mixture is then transported into diffusor 106 and thence into the hollow crankshaft 6. In the hollow crankshaft 6 are oil supply bores 140 through which the oil gets to the walls of the relatively moving parts of the rotary piston compressor 8 for lubrication and sealing.

Figure 3:
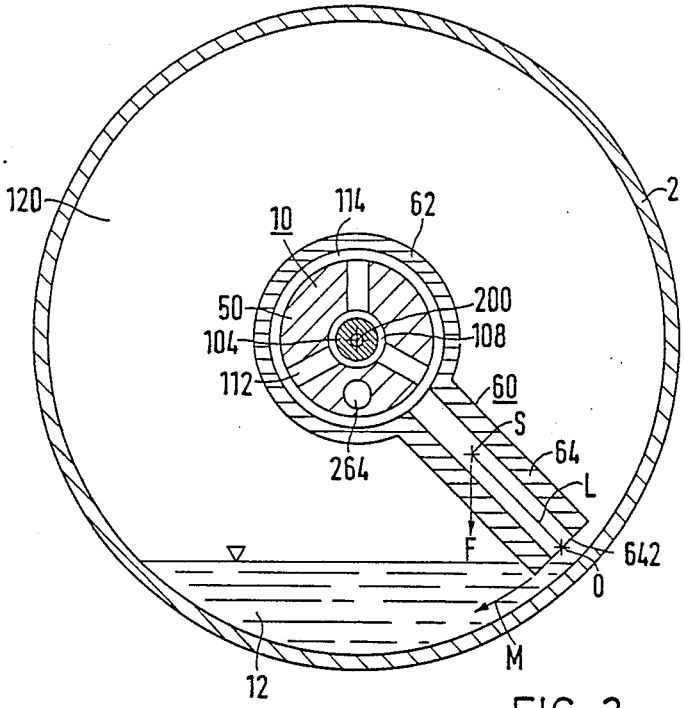
FIG. 3 shows for further explanation the oil suction device in transverse section.

In FIG. 3, the oil suction pipe 60 is shown, for further explanation, in a position in which the cylindrical pipe 64 is not parallel to the gravitational or inertial force F, which produces a torque M about axis 200. By the torque M the suction pipe 64 is oriented at least approximately parallel to the gravitational or inertial field. In the equilibrium position, its opening 642 is therefore always in the oil sump 12.

Figure 4:
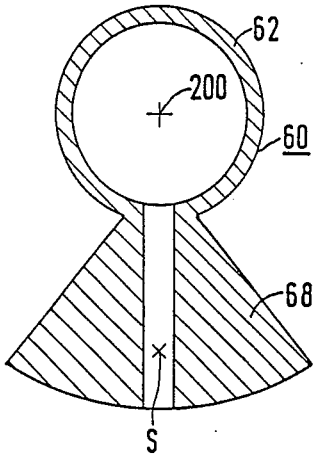
FIG. 4 shows an advantageous embodiment of the oil suction pipe in section.

In the advantageous embodiment of FIG. 4, connection piece 68 of the oil suction pipe 60 has approximately the form of a circular disk sector. This distance of the center of gravity S from axis 200 and the torque M produced by the gravitational or inertial force are thus increased accordingly as compared with the embodiment which uses a cylindrical pipe. Owing to this, bearing friction forces, which may inhibit the orientation of the oil suction pipe 60, are overcome more easily.

Figure 5:
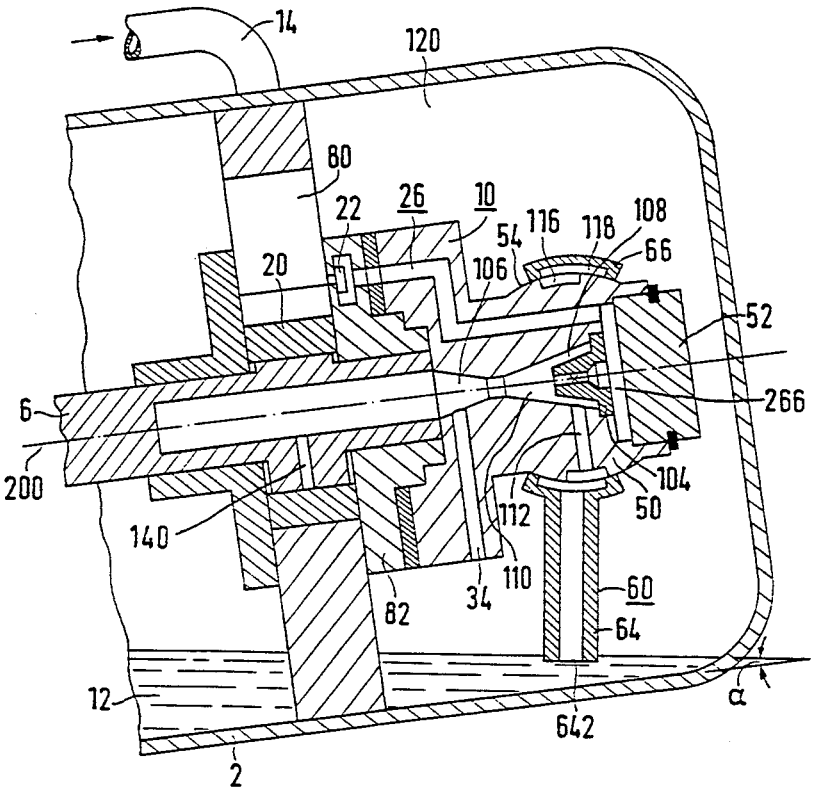
FIG. 5, a further advantageous embodiment of the rotary piston compressor, also in section.

In the embodiment of FIG. 5, the pressure valve 22 is accommodated in the part of cylinder housing 82 away from the drive. Via the compressed gas line 26 the compressed gas gets directly to the deflection chamber 266. The crankshaft 6 is hollow only inside the cylinder housing 82 and is there provided with radial bores 140. Diffusor 106 connects with the open end of crankshaft 6 and is connected with the oil chamber 120 by means of radial outlet bores 34. The compressed gas-oil mixture flows out of diffusor 106 into the oil chamber 120 and thence for example through bores (not shown in the drawing) extending parallel to the crankshaft, in the rotor of the electric motor 4, to the outlet pipe 18. This causes at the same time a cooling of motor 4.

A part 54 of the outer surface of the deflection element 50 has a surface which is generally shaped as a part of a sphere and has an annular exterior groove 116. The cross-section surface of groove 116 is for example a circular ring sector. Groove 116 is connected with the suction chamber 108 by means of bores 112 extending perpendicular to axis 200. Groove 116 is surrounded by a spherical bearing 66 of the oil suction pipe 60. The bearing 66 rides on part 54 of the outer surface of the deflection element 50. The spherical bearing 66 may likewise be provided with a peripheral groove 118 on its inner surface. The (advantageously cylindrical) bore of a pipe 64 leads into said groove 118. By this construction it is ensured that the oil suction pipe 60 can still be freely rotated about the axis 200 by the gravitational or inertial force even if said axis is inclined up to an angle $\alpha$ with respect to the surface of the oil sump 12, preventing tilting and binding of the oil suction pipe 60. Another advantage is that the angle of inclination $\alpha$ of the crankshaft 6 with respect to the surface of the oil sump 12, up to which the opening 642 of pipe 6 is still in the oil sump 12, is increased.

Those skilled in the art will understand that changes can be made in the preferred embodiments here described, and that these embodiments can be used for other purposes. Such changes and uses are within the scope of the invention, which is limited only by the claims which follow.

What is claimed is:

1. An oil-lubricated rotary piston compressor with an improved lubricating system, comprising:

an oil sump;

a compression chamber;

a piston movable within said chamber;

an axially elongated crankshaft driving said piston and having a bore through which oil from the sump is supplied to the piston;

a conduit connecting said bore with said chamber, said conduit having a constricted region intermediate said chamber and bore;

a nozzle located in said constricted region;

a diffuser located adjacent said nozzle;

an oil suction conduit having a proximal end in communication with said region and a distal end in communication with said sump, said oil suction conduit having a center of gravity; and means for pivotally securing said oil suction conduit in a manner that it is rotatable in a plane which is perpendicular to said crankshaft and in a manner that an imaginary line passing through said distal end and center of gravity intersects said crankshaft.

2. The compressor of claim 1, wherein said nozzle is rotationally symmetrical and is detachably mounted in the compressor.

3. The compressor of claim 1, wherein said nozzle is coaxial with said crankshaft.

4. The compressor of claim 1, wherein said nozzle leads into a mixing chamber and said diffuser communicates with said mixing chamber.

5. The compressor of claim 1, wherein a suction chamber is located adjacent said constricted region.

6. The compressor of claim 1, wherein said pivotably securing means operates in a manner that the oil suction conduit is also pivotable about said proximal end in the vertical plane passing through the crankshaft.

* * * * *